United States Patent [19]

Bewley, III

[11] Patent Number: 4,909,205

[45] Date of Patent: Mar. 20, 1990

[54] METHOD AND APPARATUS FOR CHANGING ENGINE OIL

[76] Inventor: Edson P. Bewley, III, 1091 Roosevelt St., Monterey, Calif. 93940

[21] Appl. No.: 298,737

[22] Filed: Jan. 19, 1989

[51] Int. Cl.[4] ..... F01M 1/00

[52] U.S. Cl. ..... 123/196 S; 184/1.5; 184/105.1

[58] Field of Search ..... 123/196 S, 196 R; 184/1.5

[56] References Cited

U.S. PATENT DOCUMENTS

| | | | |
|---|---|---|---|
| 3,447,636 | 6/1969 | Bonfilio | 123/196 R |
| 4,417,561 | 11/1983 | Yasuhara | 123/196 R |
| 4,508,195 | 4/1985 | Millet | 123/196 R |
| 4,613,014 | 9/1986 | Millet | 123/196 R |
| 4,674,456 | 6/1987 | Merritt | 123/196 S |

*Primary Examiner*—E. Rollins Cross

[57] ABSTRACT

Disclosed herein is a method of and apparatus for changing oil and an oil filter in an engine or the like having an oil sump and a mount for an oil filter. The method includes the steps of draining or adding oil to the oil sump to or from an external reservoir by use of a manually or electrically actuated pumping action. Simultaneously, if desired, the method includes the steps of changing the oil filter at a remote disconnected position. The method can be carried out by various apparatus, each of which has a first portion permanently connected to the engine to establish oil communication from the existent oil sump and filter mount to quick-disconnect couplers joined to a removable second portion including an external oil reservoir and a mount for an oil filter.

19 Claims, 2 Drawing Sheets

E
S
N
B
10
12
14
16
18
20
22
24
26
28
30
32
34
36
38
40
42
43
44
46
48
49
50
60
62
64
66
68
70
72
74
76
78
80
82
84
86
88
90
91
92
94
96
98
101
102
3

METHOD AND APPARATUS FOR CHANGING ENGINE OIL

FIELD OF THE INVENTION

The present invention relates generally to lubricant handling apparatus and, more particularly, to a method of and apparatus for changing and filtering lubricating oil in an engine or other oil user.

BACKGROUND OF THE INVENTION

All car owners are aware of the difficult and messy operation required periodically to change the lubricating oil in the engine of their cars or trucks. It is, of course, necessary initially to somehow crawl under the automobile and loosen the crankcase or oil sump drain plug to allow the dirty used oil to be drained into some receptacle. It is also frequently necessary to change the oil filter. The drain plug must, of course, be replaced and a new oil filter installed prior to refilling the engine with clean oil.

The problem is sufficiently severe to encourage most car owners to take their vehicles to a service station where the car may be elevated on a rack to ease the oil changing operation, but at considerable expense.

The problem is yet more aggravated for marine engines where service station oil changes are not readily available.

SUMMARY OF THE PRESENT INVENTION

Accordingly, it is the general objective of the present invention to provide a method of and apparatus for facilitating oil and filter changes in engines or other similar oil users so that the car, truck or boat owner can effect the operation easily and without any special tools or other equipment.

Basically, the method is very simple. After removal of the conventional drain plug, an external reservoir containing the desired quantity of clean oil is connected to the engine through the opened sump. The clean oil is then pumped into the sump and after the desired period of oil use, the now dirty oil can be pumped into the same but now empty reservoir. Such reservoir is releasably connected so that it can be disconnected and taken to a suitable disposal site. It is to be particularly noted that the entire method is carried out in an enclosed environment so that no personal contact with the clean or used oil is required.

The pumping steps can be carried out by manual actuation or by electrical actuation with a motor-driven pump which can be connected to the engine battery.

Preferably the method also includes removal of the used oil filter from the oil circulating system in the engine and the subsequent connection of a new oil filter at the same time that the clean oil is supplied. Thus, the engine is readied substantially simultaneously with clean oil and a clean oil filter.

The method can be carried out with various units that can readily be installed, a first portion remaining attached to the engine and a second portion being removably attached to the first portion.

In one embodiment, the first portion includes an adapter arranged for screwed connection to the engine at the position normally occupied by a conventional oil filter. The adapter includes fluid openings in communication with two flexible hoses which terminate in the male portions of quick-disconnect couplings. A reversible motor-driven pump is mounted on the adapter, one side of the pump being connected through a hose to the oil sump of the engine, the other side of the pump, in turn being connected to the male portion of another quick-disconnect coupling. Wire connections are made to the engine battery with a switch enabling the pump to be driven in alternate directions.

The second portion is removably joined by the female portions of the mentioned quick-disconnect couplings to a mount for a conventional oil filter so as to establish communication through the hoses and adapter to the engine, and a second mount for removable attachment to an oil reservoir in the form of a plastic container to establish fluid communication with the described pump.

Thus, in normal engine operation, the filter functions in its normal fashion and clean oil can be pumped from the reservoir into the engine oil sump when required. When an oil and filter change is required, oil is pumped from the sump into the now empty container and it can be removed for disposal. In turn, the oil filter can be readily replaced with a new clean filter.

A second embodiment is similar but utilizes a bellows which forms the oil reservoir and can be manually-actuated. When the bellows is compressed oil passes through a suitable conduit to the oil sump. In turn, if the bellows is subsequently expanded, oil from the sump will be pulled into the expanding bellows.

An oil filter is mounted adjacent the bellows and is placed in communication with the engine oil conduits by an adapter, which however, is arranged to swivel enabling various desired positioning of the attached bellows and filter.

In yet a third embodiment utilizing the same basic method, a combined annular oil bag and oil filter structure is mounted at the top of the engine around the carburetor and adjacent the existent air filter, such arrangement facilitating the removal of a used oil bag-filter unit and replacement with a new clean unit. Connections are, of course, made in a fashion similar to the other embodiments to the engine or other oil (lubricant) user.

BRIEF DESCRIPTION OF THE DRAWINGS

The stated objective of the invention and the manner in which it is achieved as summarized above will be more fully understood by reference to the following detailed description of three apparatus embodiments of the invention, each of which incorporates the same basic method, and is shown in the accompanying drawings wherein.

DETAILED DESCRIPTION OF THE DRAWING

Figures 1, 2, 3:
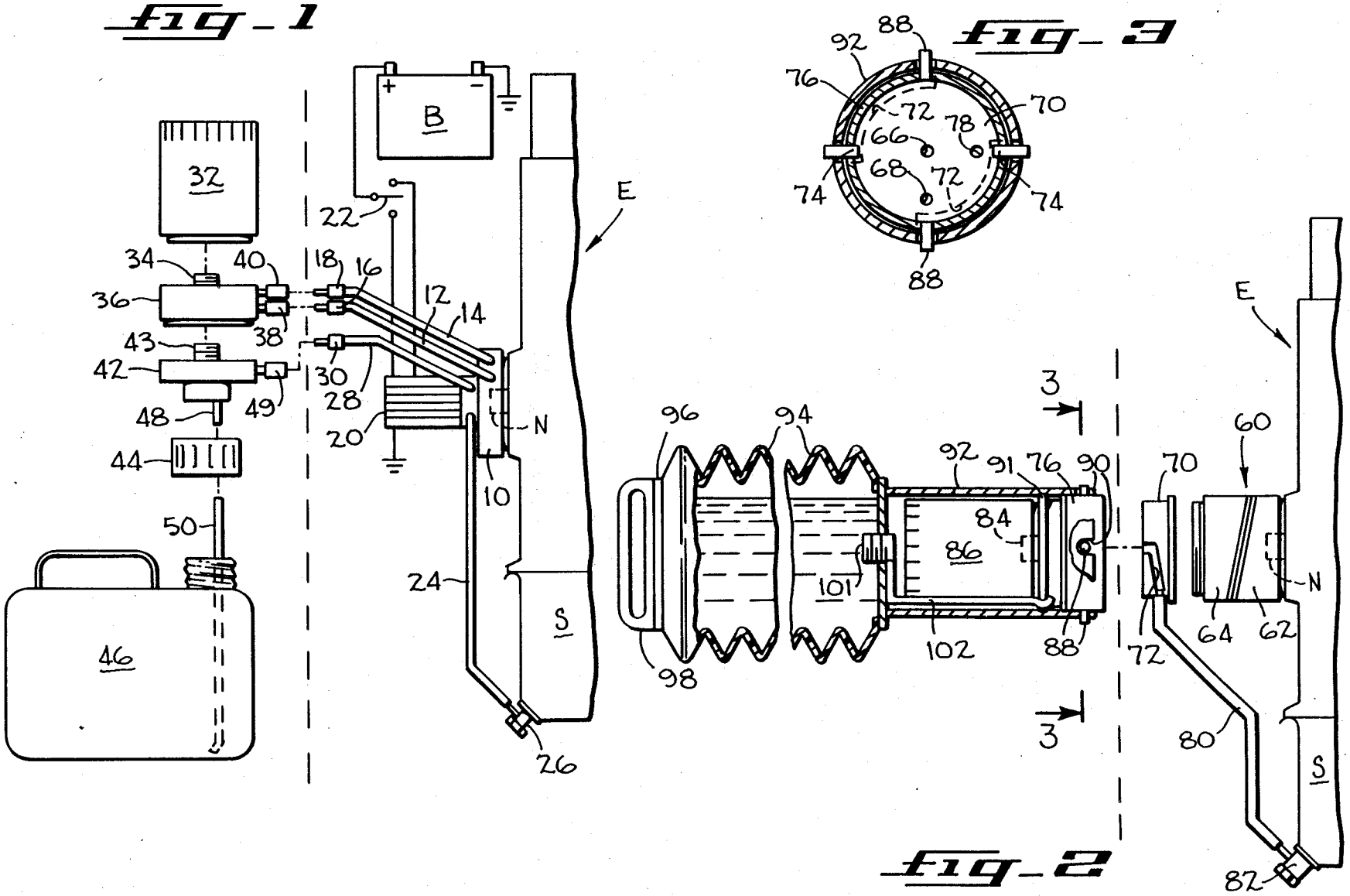
FIG. 1 is a schematic diagram of an oil changing and filtering unit shown in association with a conventional engine.
FIG. 2 is a similar schematic diagram of a second embodiment of the invention.
FIG. 3 is an enlarged cross-section taken along line 3—3 of FIG. 2.

With initial reference to FIG. 1, a portion of a conventional engine E is illustrated, having a sump S arranged to contain lubricating oil and a threaded nipple N enabling mounting or removal of a conventional oil filter.

Installation of the apparatus according to the present invention involves the initial removal of the standard drain plug (not shown) from the bottom of the sump S so that oil can be drained therefrom. In addition, the oil filter is unscrewed from its mounting nipple N.

A cylindrical adapter 10 is interiorly threaded for screwed mounting on the nipple N and contains interior conduits allowing fluid communication with flexible hoses 12, 14 which mount at their extremities male portions 16, 18 of standard quick-disconnect fluid couplers such as those manufactured by Milton Company.

The mounting adapter 10 also carries a reversible motor-driven pump 20 such as the P Q 12 volt DC unit manufactured by Greylor Company and is capable of pumping oil at a rate of 2 gallons per minute. This pump 20 is electrically connected to the engine battery B through a reversing switch 22 so that the pumping action can occur in the desired direction.

One side of the pump 20 is connected through a flexible hose 24 and a male elbow adapter 26 to the bottom opening in the engine sump S. The other side of the pump 20 is, in turn, connected by another flexible hose 28 to the male portion 30 of another quick-disconnect coupler.

This first portion of the apparatus as thus far described can remain permanently connected to the engine E, but a second portion can through use of the quick-disconnect couplings be readily disconnected as shown to the left of the dotted line in FIG. 1.

A conventional oil filter 32 is connected in standard fashion to a threaded nipple 34 on a mount 36 having internal conduits communicating with the two female portions 38, 40 of the mentioned quick-disconnect couplers.

A reservoir mount 42 is threadedly connected to the filter mount 36 by a threaded nipple 43 and rotatably supports a screw cap 44 for a plastic container 46 which forms the reservoir for a selected volume of clean oil (e.g. five quarts). The reservoir mount carries the female portion 48 of the quick-disconnect coupler and includes an interior conduit communicating with a flexible hose 50 which extends through the cap 44 into the bottom of the container 46.

Thus, when this second portion of the apparatus is connected the pump 20 can be energized to deliver the required quantity of clean oil into the sump S. During engine operation, the oil will flow through the filter 32. When the oil is dirty, the pump 20 can be energized to pump oil from the sump into the now empty plastic container 46. The quick-disconnect couplers can then be disconnected so that entire second portion of the unit including the filter 32 and container 46 can be taken to any suitable disposal site. A new container 46 with clean oil and a new filter 32 can then be installed, ready for connection to the first portion of the unit for the clean oil introduction.

It is to be particularly noted that the method of changing oil and oil filter is carried out in a fully enclosed apparatus as shown in FIG. 1 and no direct contact with the oil, dirty or clean, is required.

Essentially the same method and principle of an easy, convenient oil change can be carried out with apparatus of different specific forms. For example, FIGS. 2 and 3 illustrate a modified apparatus in which a manually-actuated pumping action is utilized.

More particularly, an angularly-variable swivel adapter 60 is mounted by screwed connection to the standard nipple N on an engine where a conventional oil filter has been removed. The swivel adapter 60 includes two sections 62, 64 physically joined at an angular disposition so when the outer section 64 is rotated, its axis will be shifted angularly thus to support other elements at a desired disposition. Communicating passages through the swivel adapter 60, in turn, communicate with aligned passages 66, 68 in a cylindrical slip ring 70 that is threadedly joined to the adapter 60. Opposed arcuate and tapered slots 72 are formed on the periphery of the slip ring 70 for the reception of interior pins 74 on a coupling cylinder 76 (see FIG. 3) which provides for a quick-disconnect mounting of an oil reservoir and filter, as will be described.

Another passage 78 through the slip ring 70 extends to its exterior where it communicates with a flexible hose 80 terminating in a male elbow adapter 82 which is screwed into the opening in the bottom of the sump S.

The structure thus far described constitutes the first portion of this second embodiment and can remain connected to the engine and, as shown by the dotted line, separated from the second removable portion of the unit.

The removable portion includes the mentioned coupling cylinder 76 having passages in registry with those in the slip ring 70. The end of the cylinder 76 mounts a threaded nipple 84 for reception of a conventional oil filter 86 whose interior communicates with the aligned passages 66, 68 in the slip ring 70 and coupling cylinder 76.

External pins 88 on the coupling cylinder 76 are received in notches 90 at the inner end of a sleeve 92 which encompasses the oil filter 86. The sleeve 92 can be slipped over the filter 86 and coupling cylinder 76 and be releasably held thereon by a circular detent 91. A bellows 94 is attached at one end to the sleeve exterior and extends for connection at its remote end to the exterior of a circular plate 96, having an attached handle 98. At its inner end, the bellows 95 is secured to another circular plate 100 having a central threaded opening which can be screwed over a nipple 101 at the end of a flexible hose 102 which extends around the oil filter 86 for connection to the passage 78 in the coupling cylinder 76.

If the bellows 94 is filled with oil in its extended position, manual pressure will cause oil to flow through the hose 102, the passage 78 and the hose 80 to the oil sump S. If, in turn, the bellows 94 is empty and collapsed, a pull on the handle 98, will effect expansion and withdrawal of oil from the sump S.

When dirty oil has been drawn into the bellows 94, the coupling cylinder 76 can be turned to provide a quick-disconnect of the bag-filter structure and removal to a disposal site. Fresh oil can then be delivered into the bellows 94 and a new filter installed by temporary removal of the exterior sleeve 92. The second portion of the bag-filter unit is thus readied for quick reconnection when another oil change is desired.

Figure 5:
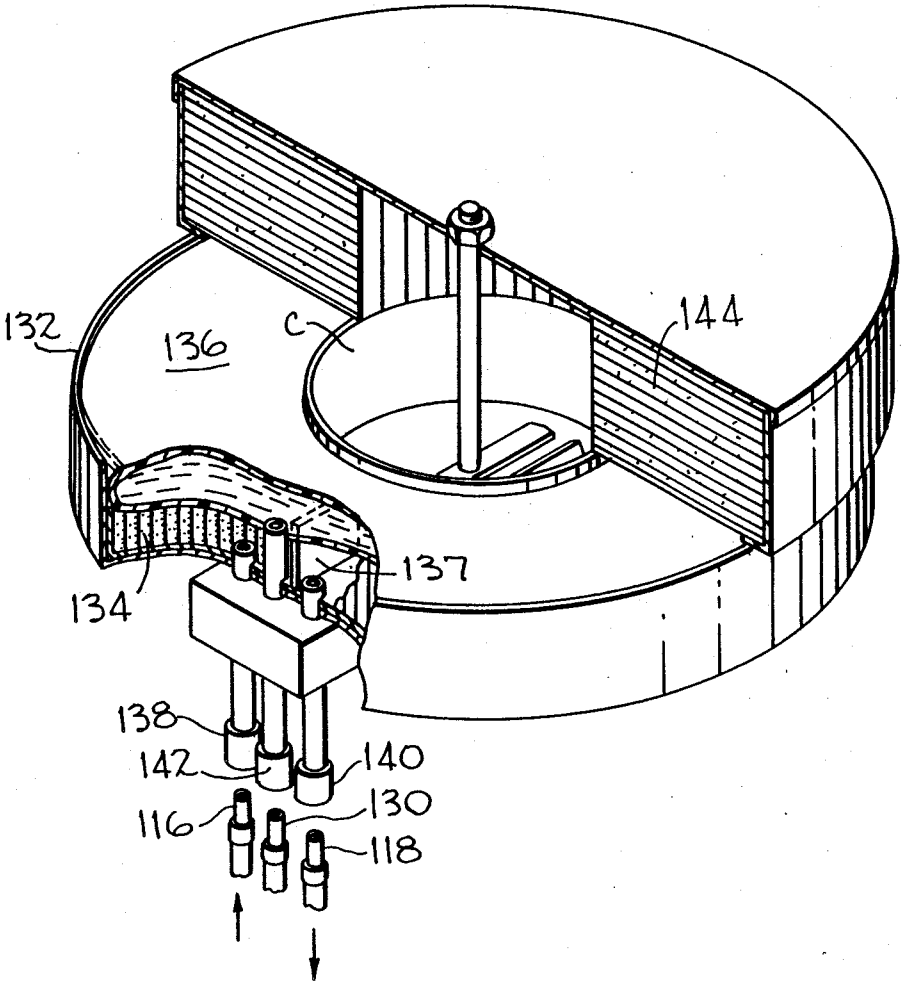
FIG. 5 is an enlarged fragmentary perspective view illustrating a particular oil-bag filter unit forming part of the FIG. 4 arrangement.
Figure 4:
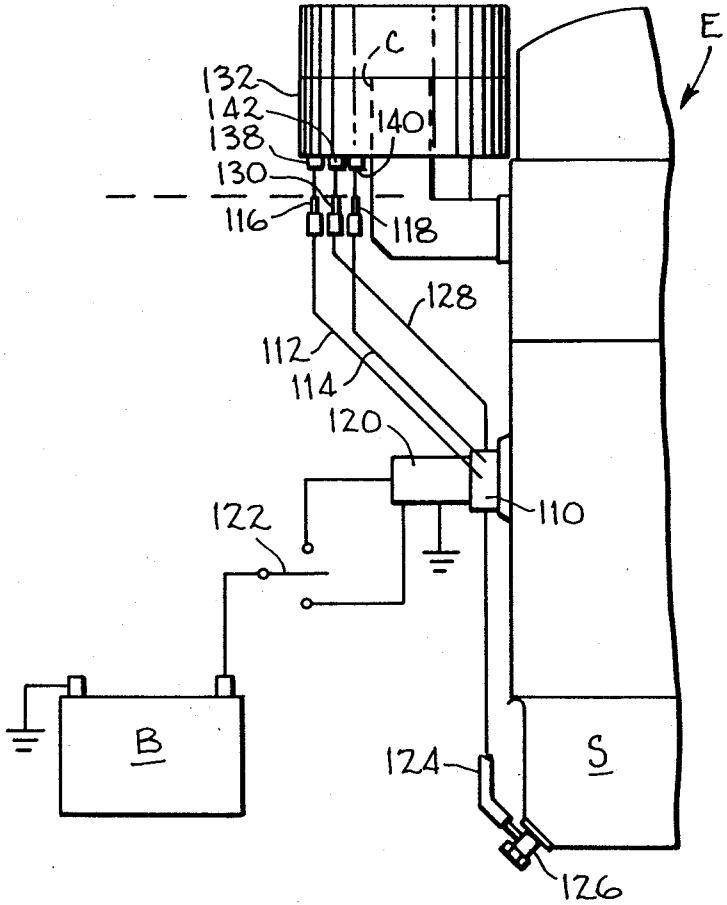
FIG. 4 is a schematic diagram showing a third embodiment of the invention.

A third embodiment of the invention utilizes the same basic method and is illustrated in FIGS. 4 and 5. As shown, an adapter 110 is joined to the engine E where an existent oil filter has been removed much in the fashion described in detail in the first embodiment of the invention shown in FIG. 1. The adapter 110 includes interior passages which communicate with two flexible hoses 112, 114 which terminate in male portions 116, 118 of quick-disconnect couplers.

The adapter also mounts a reversible motor-driven pump 120 energized from the engine battery B through a switch 122. One side of the pump 120 is connected by a flexible hose 124 to a male elbow 126 screwed into the threaded opening at the bottom of the sump S. The other side of the pump 120 is connected through a flexible hose 128 to the male portion 130 of a quick-disconnect coupler As thus far described, the structure constitutes the first portion of this arrangement which can remain permanently in position.

The second portion, separated by a dotted line in FIG. 4, which can be removed by disconnection of the quick-disconnect couplers is best shown in FIG. 5.

It is mounted on the throat of the engine carburetor C which is a position normally quite accessible at the top of the engine. The unit includes an annular bracket 132 which houses an annular oil filter 134 and an annular flexible bag 136 for reception of oil. The ends of th filter 134 on opposite sides of a partition 137 are connected by the female portions 138, 140 of the quick-disconnect couplers to the corresponding male portions 116, 118 thereof where an oil change and oil filter replacement is desired. In turn, the oil bag 136 is capable of connection through the female portion 142 of the quick-disconnect coupler to the male portion 130 enabling oil flow from the bag 136 through the pump 120 to the engine sump. Conveniently, the conventional air filter 144 can be removably mounted above the oil bag 136 and when removed in a conventional fashion enables access, removal and replacement of the oil bag 136 and oil filter 134.

While three embodiment have been illustrated, it will be obvious to those skilled in the art, that other modifications and/or alterations can be made without departing from the spirit of the invention and, as a consequence the foregoing description is not to be considered as limiting and the actual scope of the invention is to be indicated only by the appended claims.

What is claimed is:

1. The method of changing oil in an engine or the like having an oil sump which comprises the steps of connecting an external reservoir containing clean oil to the oil sump, pumping the clean oil to the oil sump, and subsequently pumping oil after use back to said external reservoir.

2. The method of changing oil according to claim 1, which comprises the initial step of draining used oil from the oil sump.

3. The method of changing oil according to claim 1 which comprises energizing the pumping action in one flow direction to pump the clean oil into the oil sump, and energizing the pumping action in the opposite flow direction to pump used oil out of the oil sump.

4. The method of changing oil according to claim 1 wherein said pumping steps are both achieved by manual actuation.

5. The method of changing oil according to claim 1 wherein said pumping steps are both achieved by electrical actuation.

6. The method of changing oil according to claim 1 which comprises simultaneously connecting an oil filter to the engine while connecting the external oil reservoir to the oil sump.

7. The method of changing oil according to claim 6 wherein said oil filter is releasably connected to the engine.

8. The method of changing oil according to claim 1 wherein said external oil reservoir is connected releasably to the oil sump.

9. Apparatus for changing oil in an engine or the like having an oil sump which comprises an oil reservoir external to the engine, means establishing oil communication between said reservoir and the engine sump, and means for pumping oil between said reservoir and the sump.

10. Apparatus for changing oil according to claim 9 wherein said reservoir is a container with a removable cap.

11. Apparatus for changing oil according to claim 9 wherein said reservoir is a flexible, collapsible bag.

12. Apparatus for changing oil according to claim 9 wherein said means for establishing oil communication includes a quick-disconnect coupling between said reservoir and the sump.

13. Apparatus for changing oil according to claim 9 wherein said pump is reversible.

14. Apparatus for changing oil according to claim 13 wherein said pump is electrically actuated.

15. Apparatus for changing oil according to claim 13 wherein said pump is manually actuated.

16. Apparatus for changing oil and an oil filter in an engine having an oil sump and an oil filter mount which comprises a first portion adapted for oil communication with the sump and the filter mount and establishing oil communication with external quick-disconnect couplers, pumping means in said first portion for establishing oil flow into and out of the sump and a second portion connected to said quick-disconnect couplers and including an external oil reservoir connected to one of said couplers, and an oil filter connected to another pair of said couplers.

17. Apparatus for changing oil and an oil filter according to claim 16 wherein said oil filter is a standard oil filter.

18. Apparatus for changing oil and an oil filter according to claim 16 wherein said external oil reservoir includes an annular bag, and said oil filter is an annular unit both of said bag and said filter are adapted for mounting around the engine carburetor throat.

19. Apparatus for changing oil and an oil filter according to claim 16 which comprises a swivel mount for said first portion allowing angular adjustment of said second portion relative thereto.

* * * * *